US008107864B2

(12) United States Patent
Saito et al.

(10) Patent No.: US 8,107,864 B2
(45) Date of Patent: Jan. 31, 2012

(54) SEPARATING MEMBER, FIXING DEVICE, AND IMAGE FORMING APPARATUS

(75) Inventors: Osamu Saito, Ibaraki (JP); Shigeo Nanno, Kyoto (JP); Tamotsu Ikeda, Osaka (JP); Kohta Sakaya, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 553 days.

(21) Appl. No.: 12/255,763

(22) Filed: Oct. 22, 2008

(65) Prior Publication Data

US 2009/0110449 A1 Apr. 30, 2009

(30) Foreign Application Priority Data

Oct. 24, 2007 (JP) ..... 2007-275838
May 21, 2008 (JP) ..... 2008-133360

(51) Int. Cl.
*G03G 15/20* (2006.01)
*G03G 21/00* (2006.01)

(52) U.S. Cl. ..... 399/323; 399/322

(58) Field of Classification Search ..... 399/322, 399/323

See application file for complete search history.

(56) References Cited

U.S. PATENT DOCUMENTS 4,929,983 A * 5/1990 Barton et al. ..... 399/323
6,661,994 B2 * 12/2003 Yamamoto et al. ..... 399/400
6,795,676 B2 * 9/2004 Kikuchi et al. ..... 399/323
7,092,665 B2 * 8/2006 Gomi et al. ..... 399/323
7,466,949 B2 * 12/2008 Satoh et al. ..... 399/323
7,937,033 B2 * 5/2011 Katabami et al. ..... 399/323

FOREIGN PATENT DOCUMENTS

JP 2001083832 A * 3/2001
JP 2006171551 A * 6/2006
JP 2007-114415 5/2007
JP 4092329 3/2008

* cited by examiner

*Primary Examiner* — David Gray
*Assistant Examiner* — Fred L Braun
(74) *Attorney, Agent, or Firm* — Oblon, Spivak, McClelland, Maier & Neustadt, L.L.P.

(57) ABSTRACT

A fixing device includes a fixing roller and a pressing roller that are in pressure contact with each other. A separating plate is placed opposite to the fixing roller with a certain gap in between them. Positioning portions are installed on the separating plate to be in contact with width-direction ends of the fixing roller for determining the gap. The positioning portions are arranged such that edges of contact portions of the positioning portions on the width-direction center side in contact with the fixing unit are positioned outside an image area and inside a paper-passing area for a recording medium of a maximum passing-capable size.

13 Claims, 8 Drawing Sheets

SEPARATING MEMBER, FIXING DEVICE, AND IMAGE FORMING APPARATUS

CROSS-REFERENCE TO RELATED APPLICATIONS

The present application claims priority to and incorporates by reference the entire contents of Japanese priority document 2007-275838 filed in Japan on Oct. 24, 2007 and Japanese priority document 2008-133360 filed in Japan on May 21, 2008.

BACKGROUND OF THE INVENTION

1. Field of the Invention

The present invention relates to an image forming apparatus, a fixing device for use in the image forming apparatus, and a separating member for use in the fixing device.

2. Description of the Related Art

A fixing device is used in image forming apparatuses, such as photocopiers or printers, to fix an image on a recording medium. However, sometimes the recording medium wraps around a fixing member in the fixing device. Japanese Patent Application Laid-open Nos. 2006-171551 and 2007-114415 disclose a conventional technology in which a separating member, such as a separating plate, is provided opposite to the fixing member to separate the recording medium from the fixing member.

A typical fixing device includes a fixing member and a pressing member that are in pressure contact with each other. The fixing member can be a fixing roller or a fixing belt. The pressing member can be a pressing roller, a pressing belt, or a pressing pad. Thus, a nip (fixing nip) is formed between the fixing member and the pressing member. The fixing member is heated by a heating unit such as a heater or an excitation coil. When a recording medium with an unfixed toner image thereon passes through the fixing nip, the toner is fixed onto the recording medium by virtue of heat and pressure.

A separating member is arranged downstream of the fixing member with respect to the running direction of the fixing member. The separating member and the fixing member are arranged such that there is a small gap between them. If a recording medium sticks to the fixing member, the separating member separates the recording medium from the fixing member so that the recording medium does not wrap around the fixing member.

How to maintain a small gap between the separating plate and the fixing member is an important issue. Japanese Patent Application Laid-open No. 2006-171551 discloses a fixing device in which positioning members are formed, by rolling or bending, on the two sides of the separating plate, and the separating plate is pushed toward the fixing member. Only the positioning members abut with the fixing member so that a small gap is maintained between the fixing member and parts of the separating plate other than the positioning members.

Japanese Patent Application Laid-open No. 2007-114415 discloses a fixing device that includes a position adjustment member that adjusts relative potions of a separating member and a fixing member. The position adjustment member adjusts the relative potions of the separating member and the fixing member such that a predetermined gap is always maintained between the separating member and the fixing member even if the fixing member thermally expands.

In the conventional fixing device, the positioning members are provided at locations that are considerably separated from a paper-passing area. Therefore, the fixing member and the separating member must be made longer in the width direction. As a result, the overall size of the fixing apparatus inevitably increases.

SUMMARY OF THE INVENTION

It is an object of the present invention to at least partially solve the problems in the conventional technology.

According to an aspect of the present invention, there is provided a fixing device including a fixing unit that fixes a toner image onto a recording medium by heating and fusing the toner image; a pressing unit that is in pressure contact with the fixing unit thereby forming a nip with the fixing unit through which a recording medium is carried; a separating unit that is arranged downstream from the nip in a running direction of the fixing unit, and placed opposite to the fixing unit with a certain gap in between; and positioning units that are installed on the separating unit to be in contact with width-direction ends of the fixing unit by being pushed directly or indirectly by a pushing unit for determining the gap, wherein the positioning units are arranged such that edges on a width-direction center side of contact portions in contact with the fixing unit are positioned outside an image area and inside a paper-passing area for a recording medium of a maximum passing-capable size.

According to another aspect of the present invention, there is provided an image forming apparatus comprising the above fixing device.

According to still another aspect of the present invention, there is provided a separating unit configured to be placed opposite to a fixing unit with a certain gap in between, the fixing unit fixing a toner image onto a recording medium by heating and fusing the toner image. The separating unit is configured to be arranged downstream from a nip in a running direction of the fixing unit, the nip being formed between the fixing unit and a pressing unit. Positioning units that are pushed by a pushing unit directly or indirectly for determining the gap, and in contact with width-direction ends of the fixing unit are installed on the separating unit. The positioning units are arranged such that edges on a width-direction center side of contact portions of the positioning units in contact with the fixing unit are positioned outside an image area and inside a paper-passing area for a recording medium of a maximum passing-capable size.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
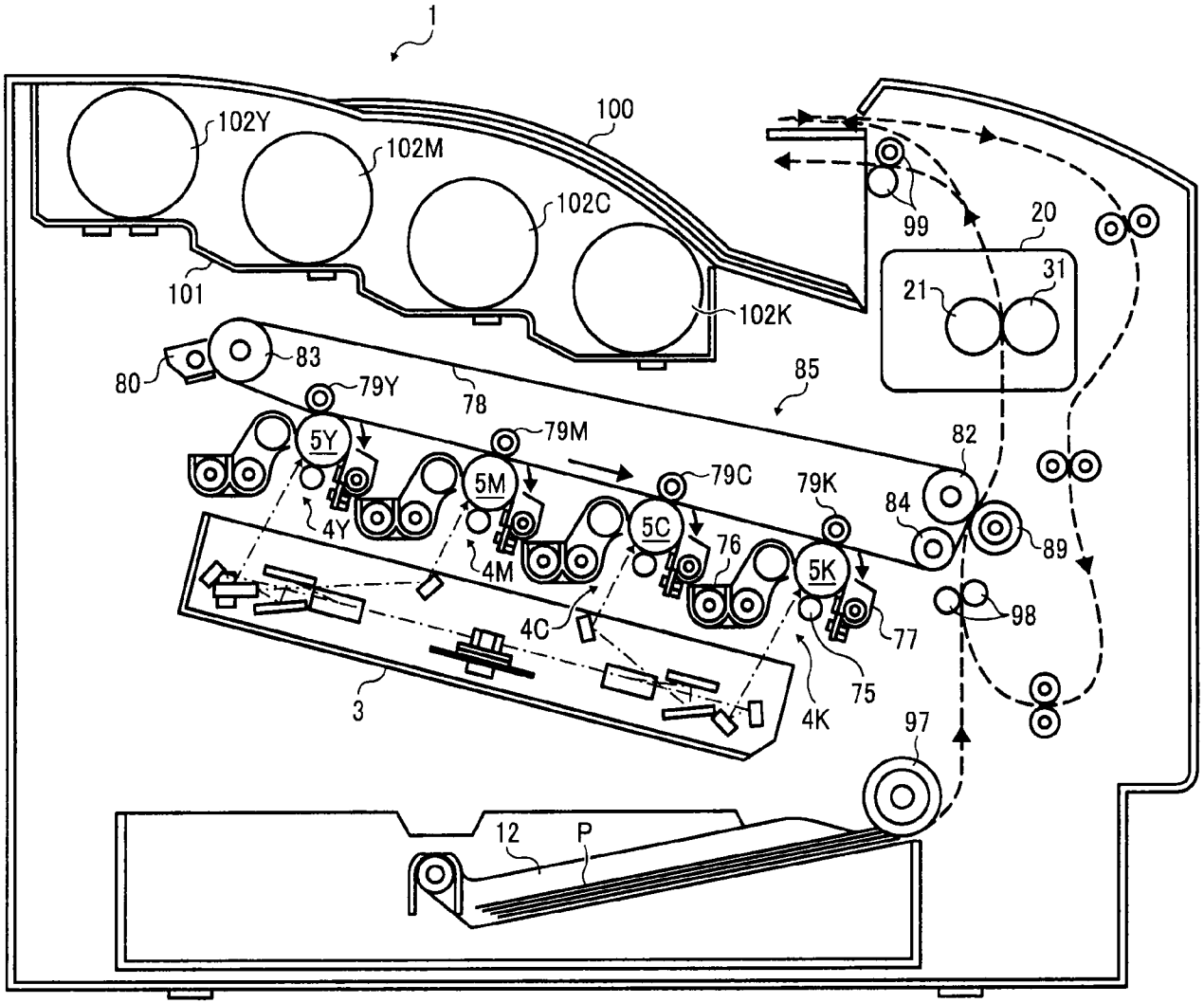
FIG. 1 is a schematic diagram of an image forming apparatus according to a first embodiment of the present invention.

Exemplary embodiments of the present invention will be explained below in detail with reference to the accompanying drawings. The components that have the same or similar structure, or the components that perform the same or similar functions in the embodiment are assigned with the same reference numeral, and repetition of the explanation of those elements is appropriately simplified or omitted.

An image forming apparatus 1 according to a first embodiment of the present invention is explained below in detail with reference to FIGS. 1 to 12.

The image forming apparatus 1 is a tandem color printer. A bottle housing 101 arranged in the upper part of the main body of the image forming apparatus 1 includes four toner bottles 102Y, 102M, 102C, and 102K corresponding to four colors, namely, yellow, magenta, cyan, and black, respectively, which are placed in a detachable (replaceable) manner.

An intermediate transfer unit 85 is arranged below the bottle housing 101. Image forming units 4Y, 4M, 4C, and 4K corresponding to the four colors, yellow, magenta, cyan, and black, respectively, are provided in parallel to be opposed to an intermediate transfer belt 78 of the intermediate transfer unit 85.

Photoconductor drums 5Y, 5M, 5C, and 5K are arranged in the image forming units 4Y, 4M, 4C, and 4K, respectively. A charging unit 75, a development unit 76, a cleaning unit 77, a static eliminator unit (not shown), and the like are arranged around each of the photoconductor drums 5Y, 5M, 5C, and 5K. Image forming processes, namely, a charging process, a light exposure process, a development process, a transfer process, and a cleaning process, are then performed on the photoconductor drums 5Y, 5M, 5C, and 5K, so that an image of each color is formed on each of the photoconductor drums 5Y, 5M, 5C, and 5K.

The photoconductor drums 5Y, 5M, 5C, and 5K are rotationally driven clockwise in FIG. 1 by a not-shown driving motor. The charging unit 75 uniformly charges a surface of each of the photoconductor drums 5Y, 5M, 5C, and 5K that opposes the charging unit 75 (the charging process).

The charged surface of each of the photoconductor drums 5Y, 5M, 5C, and 5K then reaches a position at which a laser beam emitted from a light exposure unit 3 strikes the charged surface. As a result, the charged surface is exposed and an electrostatic latent image corresponding to each of the colors is formed on the charged surface (the light exposure process).

The electrostatic latent image on each of the photoconductor drums 5Y, 5M, 5C, and 5K then reaches a position opposite to the development unit 76. The development unit 76 develops the electrostatic latent image into a toner image of a corresponding color by applying toner of the corresponding color to the electrostatic latent image (the development process).

The toner image on each of the photoconductor drums 5Y, 5M, 5C, and 5K then reaches a position opposite to a corresponding primary-transfer bias roller 79Y, 79M, 79C, and 79K. Because of the bias between the primary-transfer bias rollers 79Y, 79M, 79C, and 79K and the photoconductor drums 5Y, 5M, 5C, and 5K, the toner image on each of the photoconductor drums 5Y, 5M, 5C, and 5K is transferred onto the intermediate transfer belt 78 (a primary transfer process). Some toner may remain on the photoconductor drums 5Y, 5M, 5C, and 5K.

The surface of each of the photoconductor drums 5Y, 5M, 5C, and 5K then reaches a position opposite to the cleaning unit 77. The cleaning unit 77, which can be a cleaning blade, mechanically cleans any toner that may have remained on a corresponding one of the photoconductor drums 5Y, 5M, 5C, and 5K (the cleaning process).

Finally, the surface of each of the photoconductor drums 5Y, 5M, 5C, and 5K reaches a position opposite to the static eliminator unit, and residual potential on each of the photoconductor drums 5Y, 5M, 5C, and 5K is eliminated at the position.

In this way, a series of the image forming processes performed on the photoconductor drums 5Y, 5M, 5C, and 5K is finished.

The single-color toner images formed on the photoconductor drums 5Y, 5M, 5C, and 5K are then transferred onto the intermediate transfer belt 78 in a superposed manner. In this way, a full-color toner image is formed on the intermediate transfer belt 78.

The intermediate transfer unit 85 includes the intermediate transfer belt 78, the four primary-transfer bias rollers 79Y, 79M, 79C, and 79K, a secondary-transfer backup roller 82, a cleaning backup roller 83, a tension roller 84, a belt cleaning unit 80, and the like. The intermediate transfer belt 78 is stretched and supported by the three rollers 82 to 84, and endlessly moved in the direction of an arrow shown in FIG. 1 by rotational driving of the secondary-transfer backup roller 82.

The intermediate transfer belt 78 is sandwiched between the primary-transfer bias rollers 79Y, 79M, 79C, and 79K and the photoconductor drums 5Y, 5M, 5C, and 5K. Thus, a primary transfer nip is formed between each of the primary-transfer bias rollers 79Y, 79M, 79C, and 79K and each of the photoconductor drums 5Y, 5M, 5C, and 5K. A transfer bias inverse to the polarity of toner is then applied onto the primary-transfer bias rollers 79Y, 79M, 79C, and 79K.

When the intermediate transfer belt 78 passes through the primary transfer nips, because of the transfer bias between the toner of the toner images on the photoconductor drums 5Y, 5M, 5C, and 5K and the primary-transfer bias rollers 79Y, 79M, 79C, and 79K, the toner images are primary transferred onto the intermediate transfer belt 78 in a superposed manner.

The intermediate transfer belt 78 is sandwiched between the secondary-transfer backup roller 82 and the secondary transfer roller 89. Thus, a secondary transfer nip is formed between the secondary-transfer backup roller 82 and the secondary transfer roller 89. The intermediate transfer belt 78 with the full-color toner image then reaches the secondary transfer nip. At the timing at which the full-color toner image reaches the secondary transfer nip, a recording medium P also reaches the secondary transfer nip. Specifically, the recording medium P is sandwiched between the intermediate transfer belt 78 and the secondary transfer roller 89. As a result, the full-color toner image on the intermediate transfer belt 78 is transferred onto the recording medium P. Some toner may remain on the intermediate transfer belt 78.

The intermediate transfer belt 78 then reaches the position of the belt cleaning unit 80. The belt cleaning unit 80 cleans any toner that may have remained on the intermediate transfer belt 78.

In this way, a series of the transferring processes performed on the intermediate transfer belt 78 is finished.

A paper feeding unit 12 is arranged in the lower part of the main body of the image forming apparatus 1. One recording media P is picked-up from the paper feeding unit 12 and fed to the secondary transfer nip.

Specifically, one or more sheets of the recording medium P, such as transfer paper, are piled and stocked in the paper feeding unit 12. When the paper feeding roller 97 is rotationally driven anticlockwise in FIG. 1, it picks-up a sheet of the recording medium P on the top and feeds it between the registration rollers 98.

The recording medium P is once stopped between the registration rollers 98. Adjusting timing in accordance with the entry in the secondary transfer nip of the full-color image on the intermediate transfer belt 78, the registration rollers 98 are then rotationally driven so that the recording medium P held between the registration rollers 98 is carried to the secondary transfer nip. As a result, the full-color toner image on the intermediate transfer belt 78 is transferred onto the recording medium P.

The recording medium P with the unfixed full-color toner image is then conveyed to a fixing device 20. The fixing device 20 fixes the full-color toner image onto the recording medium P. The recording medium P with the fixed image is then delivered to the outside of the image forming apparatus 1 by a pair of paper-delivery rollers 99.

The recording medium P delivered by the paper-delivery roller pair 99 to the outside of the apparatus is stacked up on a stack unit 100 as an output image one after another.

In this way, a series of image forming processes performed by the image forming apparatus is completed.

A configuration and operation of the fixing device 20 is explained below in detail with reference to FIGS. 2 to 12. The fixing device 20 includes a fixing roller 21 as a fixing member, a pressing roller 31 as a pressing member, a separating plate 38 as a separating member, guide plates 35, and a temperature sensor 40.

Figure 2:
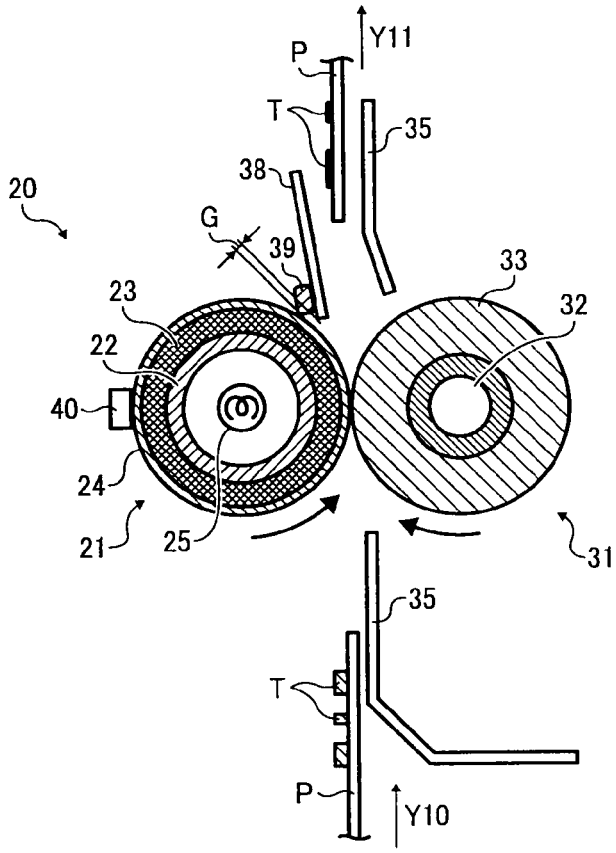
FIG. 2 is an enlarged view of a fixing device shown in FIG. 1.

The fixing roller 21 is a thin cylinder that rotates in the direction of an arrow shown in FIG. 2. A heater 25 (a heat source) as a heating unit is arranged inside the fixing roller 21. The fixing roller 21 has a multilayered structure in which an elastic layer 23 is formed on a central core bar 22, and a release layer 24 is formed on the elastic layer 23. The fixing roller 21 is in pressure contact with the pressing roller 31. Thus, a fixing nip is formed between the fixing roller 21 and the pressing roller 31.

The core bar 22 is made from iron material such as SUS304. The elastic layer 23 is made of elastic material such as fluororubber, silicone rubber, or expandable silicone rubber. The release layer 24 is made from tetrafluoroethylene perfluoroalkyl vinyl ether copolymer resin (PFA), polyimide, polyether-imide, polyether sulfide (PES), or the like. As the release layer 24 is provided on the surface layer of the fixing roller 21, releasability to toner T (a toner image) is ensured.

The heater 25 can be a halogen heater. Both ends of the heater 25 are fastened on a frame (not shown) of the fixing device 20. A power unit (alternating-current power source) (not shown) controls ON/OFF of the heater 25. When the heater 25 is turned ON, it heats the fixing roller 21. The temperature sensor 40 measures the surface temperature of the fixing roller 21. The power unit controls the heater 25 based on the temperature measured by the temperature sensor 40. Specifically, an alternating-current voltage is applied to the heater 25 for a power distribution time determined based on a detection result obtained by the temperature sensor 40. As a result, the temperature of the fixing roller 21 (fixing temperature) can be adjusted and controlled to a desired temperature (target control temperature).

The temperature sensor 40 can be a contact-type thermister, a noncontact-type thermopile, or some other temperature sensor.

The pressing roller 31 principally includes a central core bar 32 and an elastic layer 33 stuck on the core bar 32 with adhesive. The elastic layer 33 is made from fluororubber, silicone rubber, or expandable silicone rubber. A release layer made from, for example, PFA, can be provided on the elastic layer 33.

The pressing roller 31 is in pressure contact with the fixing roller 21. A pressing unit (not shown) relatively presses the pressing roller 31 and the fixing roller 21 toward each other. In this way, a desired fixing nip is formed between the pressing roller 31 and the fixing roller 21.

One of the guide plates 35 is provided on the side from where the recording medium P enters into the fixing nip and other of the guide plates 35 is provided on the side from where the recording medium P exits from the fixing nip. These guide plates 35 guide entry and exit of the recording medium P into and from the fixing nip. The guide plates 35 are fixed to a housing of the fixing device 20.

The separating plate 38 as a separating member opposite to the fixing roller 21 with a certain gap G in between is arranged downstream from the fixing nip (in the vicinity of the outlet side of the nip) in a running direction (rotational direction) of the fixing roller 21. The separating plate 38 prevents wrapping of the recording medium P around the fixing roller 21. The separating plate 38 can be made from a metal or a heat-resistant resin.

Figure 3:
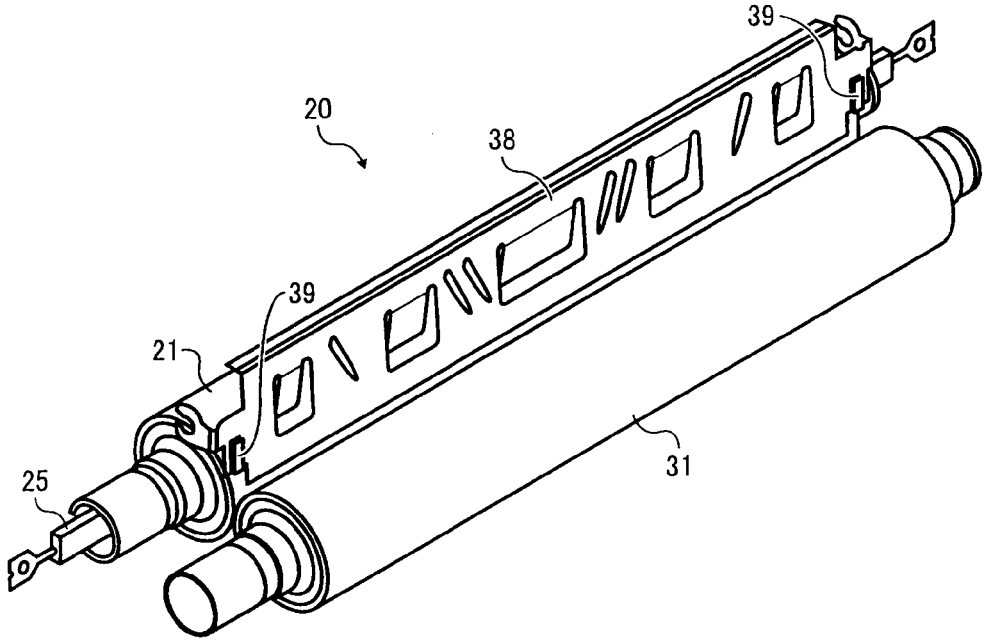
FIG. 3 is a perspective view of the fixing device shown in FIG. 2.
Figure 4:
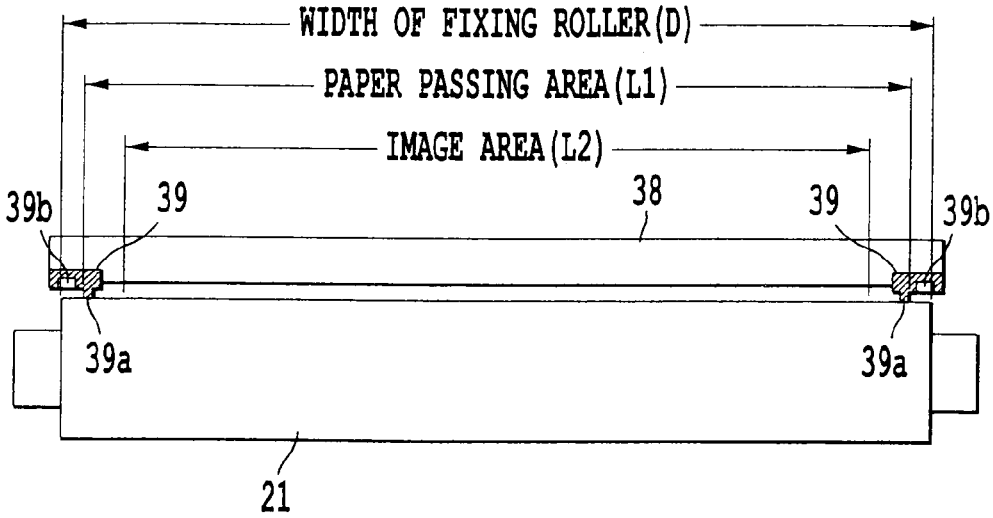
FIG. 4 is a schematic diagram that depicts the relation between a fixing roller and a separating plate shown in FIG. 3.
Figure 5:
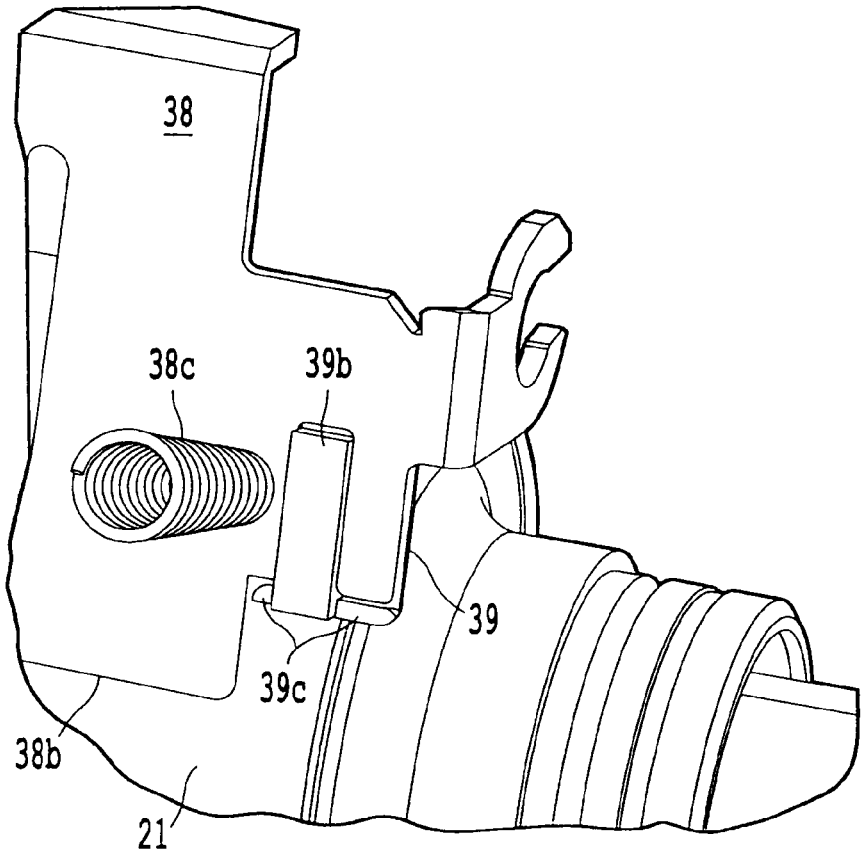
FIG. 5 is an enlarged perspective view that depicts the vicinity of a positioning member shown in FIG. 3.

As shown in FIGS. 3 to 5, both edges in the width direction of the separating plate 38 (the direction perpendicular to the cross-sectional surface shown in FIG. 2) are provided with positioning members 39 (projected contact members) for determining the gap G between the separating plate 38 and the fixing roller 21. Each of the positioning members 39 is indirectly pushed (by being pushed together with the separating plate 38 toward the fixing roller 21) by a pushing unit 38*c*, such as a spring connected to each of the edges of the separating plate 38. As a result, the positioning members 39 come into contact with the both of width-direction ends of the fixing roller 21. As a result, the gap G appropriate to the thickness of the positioning members 39 (that is a portion present between the separating plate 38 and the fixing roller 21) is formed.

The gap G between the fixing roller 21 and the separating plate 38 is set to be from 0.1 millimeter to 0.8 millimeter under a state where the fixing roller 21 is heated. In other words, the gap G is set to be from 0.1 millimeter to 0.8 millimeter under a state where the fixing device 20 is activated, and components, such as the fixing roller 21, the separating plate 38, and the positioning members 39, have expanded due to heat. If the gap G is smaller than 0.1 millimeter, dirt on the fixing roller 21 may be transferred to the separating plate 38 and contaminate the recording medium P, or the separating plate 38 may contact the fixing roller 21 and may damage the surface of the fixing roller 21. If the gap G is larger than 0.8 millimeter, a primary purpose of preventing wrapping of the recording medium P around the fixing roller 21 is not achieved.

Preferably, the positioning members 39 are made from a heat resistant resin or a metal. When the positioning members 39 are made from resin, the surface of the fixing roller 21 is more resistant to damage. When the positioning members 39 are made from metal, a large deformation does not occur even when the positioning members 39 reach a high temperature, so that the gap G can be maintained stably.

Instead of indirectly pushing the positioning members 39 by the pushing unit, the positioning members 39 can be directly pushed by a pushing unit.

The fixing device 20 configured as described above operates as described below. When a power switch of the main body of the image forming apparatus 1 is turned on, an alternating-current voltage is applied (supplied) to the heater 25 from an alternating-current power source, and rotational driving of the fixing roller 21 and the pressing roller 31 in the direction of arrows shown in FIG. 2 is started.

The recording medium P with an unfixed toner image thereon is fed from the secondary transfer nip to the fixing device 20. Specifically, the recording medium P with the unfixed toner image T is carried in the direction of an arrow Y10 shown in FIG. 2, and inserted into the fixing nip between the fixing roller 21 and the pressing roller 31. The toner image T is then fixed onto the surface of the recording medium P by virtue of heat from the hot fixing roller 21 and by virtue of a pressing force of the fixing roller 21 and the pressing roller 31. The recording medium P sent out from the fixing nip by the fixing roller 21 and the pressing roller 31 both of which are rotating is then carried in the direction of an arrow Y11.

Characteristics of the configuration and operation of the fixing device 20 according to the first embodiment are explained below with reference to FIGS. 3 to 12.

As explained above, the positioning members 39 (projected contact members) for determining the gap G between the separating plate 38 and the fixing roller 21 are provided on the both of the width-direction edges of the separating plate 38.

Each of the positioning members 39 is provided with a contact portion 39*a* that is in contact with the fixing roller 21, and a fitting portion 39*b* with which the positioning member 39 is detachably installed onto the separating plate 38. As shown in FIG. 4, the contact portions 39*a* are arranged such that edges on the width-direction center side of the contact portions 39*a* are positioned inside a paper-passing area L1 for a recording medium of a maximum passing-capable size, and outside an image area L2.

The paper-passing area L1 is the sum of a width-direction range of the recording medium P of a maximum passing-capable size (for example, the A3 size) defined in specifications of the image forming apparatus 1, and variability and a skew of a carrying position of the recording medium P determined in accordance with the specifications.

The paper-passing area L1 is the sum of a width-direction range of the recording medium P that ensures an image quality (image-quality ensuring width) defined in the specifications for the recording medium P of the maximum passing-capable size (for example, the A3 size) defined in the specifications, and the variability and the skew of a carrying position of the recording medium P determined in accordance with the specifications.

Thus, the contact portions 39*a* can be arranged at the innermost position on the width-direction center side of the positioning members 39 without influencing the image quality.

Because the contact portions 39*a* make sliding contact with the fixing roller 21 and the contact portions 39*a* may damage the surface of the fixing roller 21, it is desirable that the contact portions 39*a* do not contact the fixing roller 21 within the image area L2. On the other hand, if the contact portions 39*a* are arranged at a long distance outside the image area L2, i.e., a large margin in the width direction is provided, the fixing roller 21 and the separating plate 38 become large in the width direction. By contrast, according to the first embodiment, a margin in the width direction is set to a minimum as the contact portions 39*a* are configured to be arranged outside the image area L2 even when part of (or the whole of) the contact portion 39*a* comes in the paper-passing area L1, so that sizes of the fixing roller 21 and the separating plate 38 in the width direction can be set to a minimum. Consequently, reduction in size, weight, and cost of the fixing device 20 can be achieved.

Although part of (or the whole of) the contact portions 39*a* is arranged within the paper-passing area L1, the paper-passing area L1 is a range added with variability and a skew of a carrying position of the recording medium P, preliminarily including a margin in the width direction, so that a jam hardly occurs due to contact between the contact portions 39*a* and the recording medium P, that is, the recording medium P can be carried without loss in performance.

If the recording medium P being carried comes into contact with any of the contact portions 39*a*, a contact area is slight, and a contact portion of the recording medium P is carried to escape from the contact portions 39*a*, so that a jam of the recording medium P hardly occurs due to contact between the contact portions 39*a* and the recording medium P.

In the first embodiment, the fitting portions 39*b* of the positioning members 39 are arranged outside the paper-passing area L1. The fitting portions 39*b* are constructed large in size to fasten the positioning members 39 onto the separating plate 38 securely. Due to the large size, there is a possibility that the fitting portions 39*b* may project to the fixing roller 21 side, and may obstruct carrying of the recording medium P. Therefore, a trouble of loss in performance of carrying of the recording medium P can be prevented beforehand by arranging the fitting portions 39*b* outside the paper-passing area L1.

Each of the fitting portions 39*b* is form ed as a snap-fit. Because of the snap-fits, installation work of the positioning members 39 to the separating plate 38 can be simplified, and the number of pieces of parts relevant to the installation work can be reduced.

Figure 6:
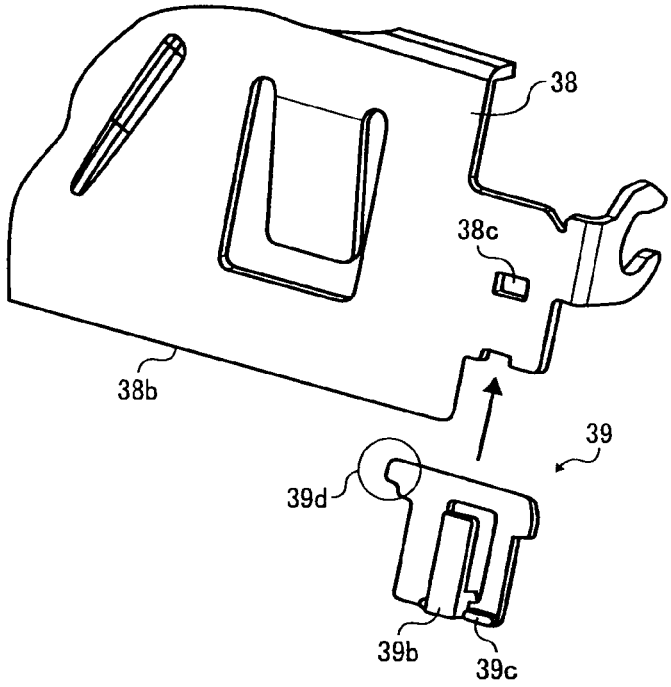
FIG. 6 is a schematic diagram that depicts attachment of the positioning member shown in FIG. 5 to the separating plate.
Figure 7:
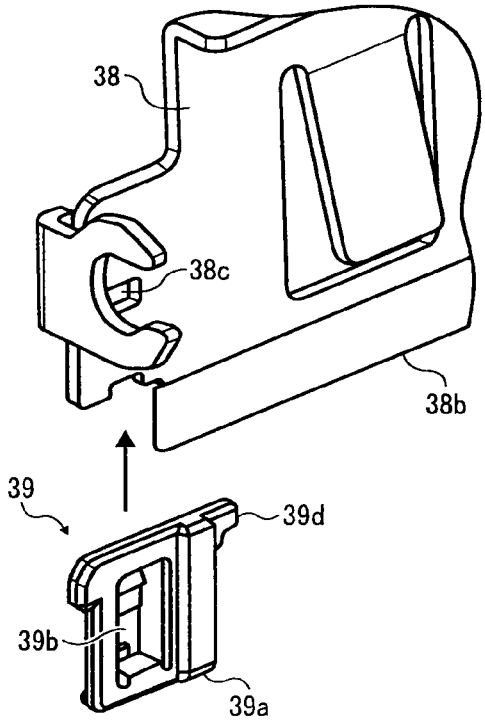
FIG. 7 is another schematic diagram that depicts attachment of the positioning member to the separating plate.

Specifically, as shown in FIGS. 6 and 7, the positioning member 39 is moved from below the separating plate 38 in the direction of an arrow shown in each of the figures, and installed onto the separating plate 38 by engaging the fitting portion 39*b* (snap-fit) into a hole 38*c* provided on the separating plate 38.

Referring to FIGS. 6 and 7, a projection 39*d* that projects from the contact portion 39*a* to the width-direction center side is formed on each of the positioning members 39. When installing one of the positioning members 39 to an edge of the separating plate 38, the projection 39*d* prevents a mistake of installing the other one (formed symmetrically) of the positioning members 39 to be placed on the other edge.

Figure 8:
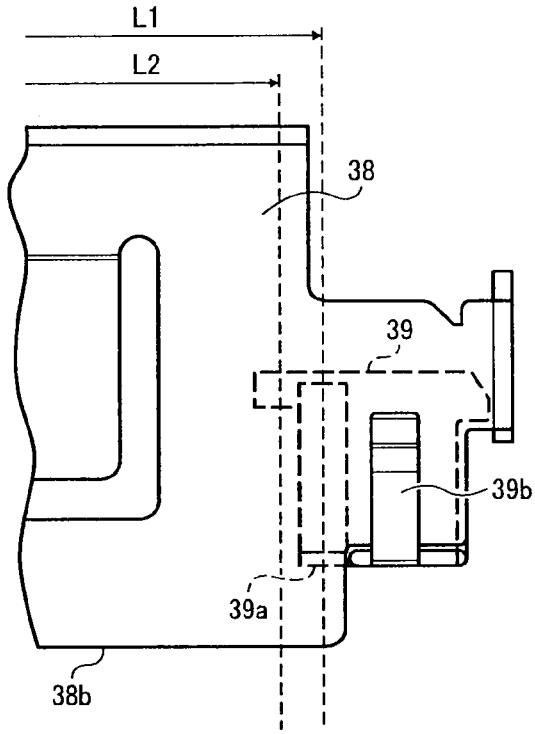
FIG. 8 is a schematic diagram that depicts the relation between a tip of the separating plate and a paper-passing area shown in FIG. 4.

The contact portions 39*a* are arranged to overlap with the back of the separating plate 38 (on the opposite side of the carrying surface for the recording medium P). Accordingly, as shown in FIG. 8, the position of a tip 38*b* of the separating plate 38 on a width-direction edge at which the gap G with the fixing roller 21 is formed can be arranged outside the paper-passing area L1. Consequently, a problem that the recording medium P is jammed at the position of the separating plate 38 can be securely prevented.

Furthermore, as shown in FIG. 4, the contact portions 39*a* are arranged such that the edges of the contact portions 39*a* on the width-direction edge sides are positioned inside the width-direction ends of the fixing roller 21 (within an area D). Specifically, the position of each edge of the contact portions 39*a* on each width-direction edge side is arranged at three millimeters or more inside (on the width-direction center side) from each of the width-direction ends of the fixing roller 21. Therefore, even if a wing in a burr shape caused by manufacturing (that is a sort of a burr, and slightly projects in a direction causing a larger outer diameter) is formed on a width-direction end of the fixing roller 21, a trouble of interference between the wing and the contact portions 39*a* can be avoided.

Stoppers 39*c* that restrict rotation of the contact portion 39*a* around the fitting portion 39*b* (snap-fit) are provided on the positioning member 39 as shown in FIG. 5. As described above, because the contact portion 39*a* is arranged to overlap the paper-passing area L1, while the fitting portion 39*b* is arranged outside the paper-passing area L1, a rotation moment around the fitting portion 39*b* is applied to the positioning member 39 due to sliding contact between the contact portion 39*a* and the fixing roller 21. If the positioning member 39 is rotated, there is a possibility that an attitude of the contact portion 39*a* may be changed, and the gap G between the fixing roller 21 and the separating plate 38 may be changed. As described above, if the gap G is too small, the separating plate 38 may be contaminated, or the fixing roller 21 may be damaged; on the other hand, if the gap G is too large, performance of the primary function of the separating plate 38 is reduced.

Because the stoppers 39*c* come in contact with the bottom end of the separating plate 38 when a rotation moment is applied to the positioning member 39 are provided to the both edges of the fitting portion 39*b*, rotation of the positioning member 39 can be avoided, and change in the gap G can be prevented.

Figure 9:
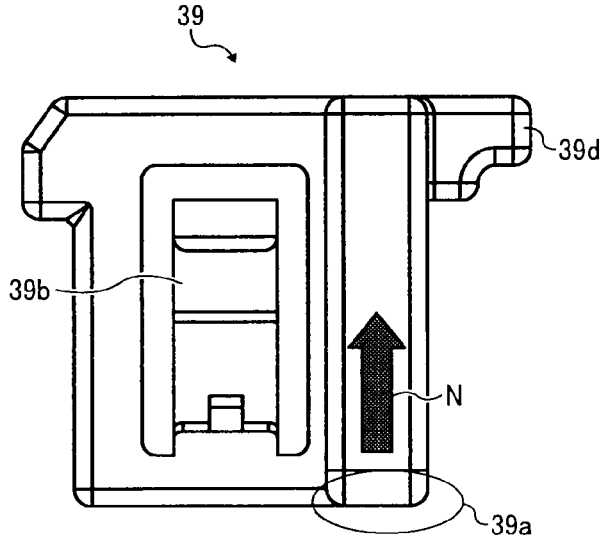
FIG. 9 is a schematic diagram of the positioning member.
Figure 10:
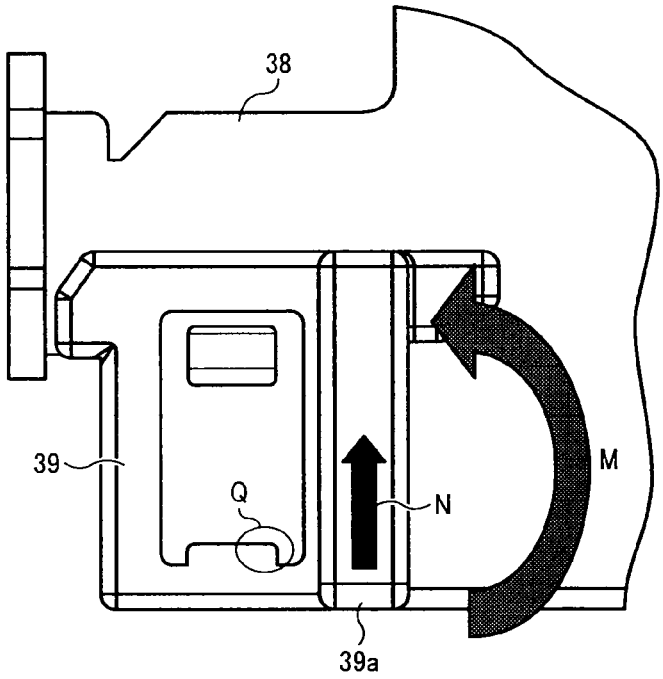
FIG. 10 is a schematic diagram for explaining force acting on the positioning member in a state that the positioning member is attached to the separating plate.
Figure 11:
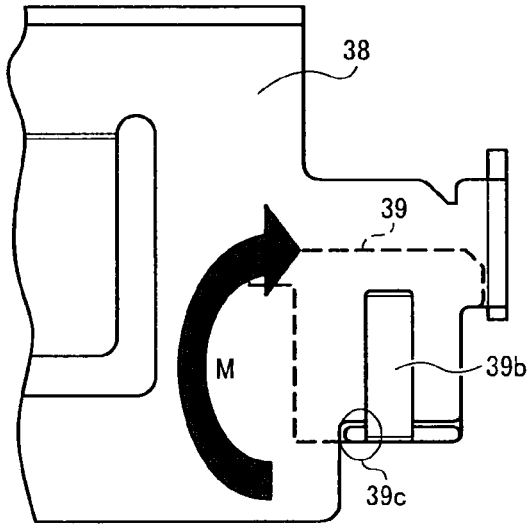
FIG. 11 is a schematic diagram for explaining force acting on the positioning member in a state that the positioning member is attached to the separating plate when viewed from the carrying surface side of the separating plate.
Figure 12:
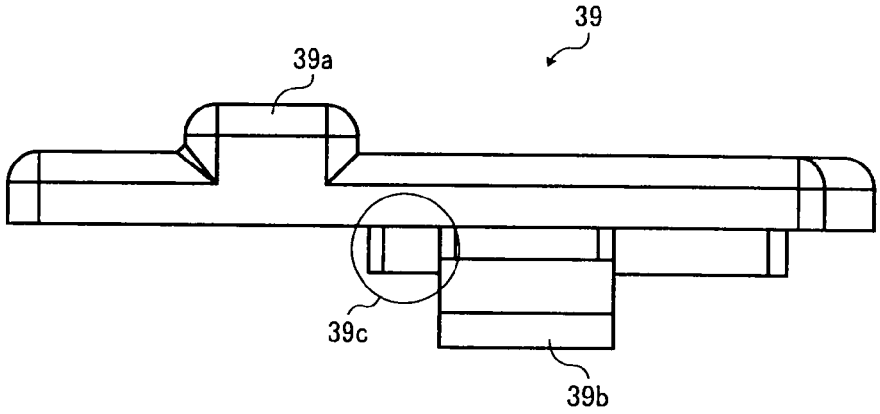
FIG. 12 is a top view of the positioning member.

The stoppers 39*c* are explained below in more detail with reference to FIGS. 9 to 12. FIG. 9 is a schematic diagram of the positioning member 39 when looking at it from the back (the opposite side of the carrying surface of the separating plate 38). FIG. 10 is a schematic diagram that depicts a force applied to the positioning member 39 installed onto the separating plate 38, when looking at it from the back of the separating plate 38. FIG. 11 is a schematic diagram that depicts a force applied to the positioning member 39 installed onto the separating plate 38, when looking at it from the carrying surface of the separating plate 38. FIG. 12 is a top view of the positioning member 39.

As shown in FIGS. 9 to 11, the contact portion 39*a* in contact with the fixing roller 21 is applied with a force in the direction of an arrow N along the rotational direction of the fixing roller 21. Due to the force, the positioning member 39 is applied with a rotation moment M around a part Q (as a fulcrum) (see FIG. 10) of the fitting portion 39*b*. However, the stoppers 39*c* are formed on the bottom edge of the positioning member 39, so that as the stoppers 39*c* knock into the separating plate 38, a rotation of the positioning member 39 with the rotation moment M is prevented.

As explained above, the edges on the width-direction center side of the contact portions 39*a* of the positioning members 39 are positioned inside the paper-passing area L1 and outside the image area L2. As a result, a fixing device (or an image forming apparatus) with stable and small gap G between a fixing roller and a separating plate, having relatively shorter fixing roller and separating plate, and having an overall small size can be realized.

Figure 13:
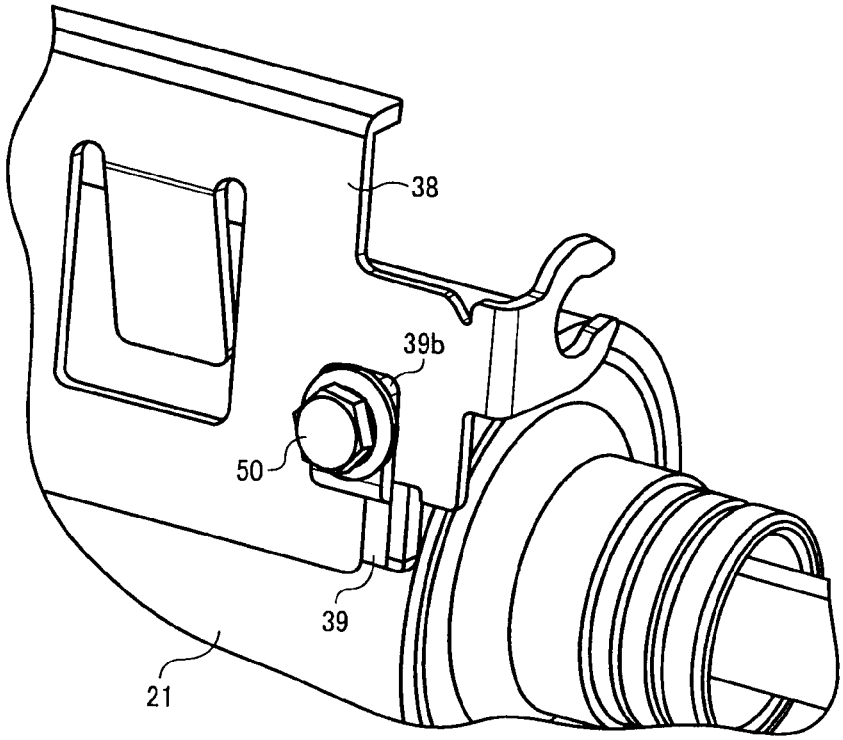
FIG. 13 is an enlarged perspective view that depicts the vicinity of a positioning member of a fixing device according to a second embodiment of the present invention.

A second embodiment according to the present invention is explained below in detail. FIG. 13 is an enlarged perspective view that depicts the vicinity of a positioning member of a fixing device according to the second embodiment, corresponding to FIG. 5 according to the first embodiment. The fixing device according to the second embodiment differs from the one according to the first embodiment in an installation method of the positioning members 39 to the separating plate 38.

The fixing device according to the second embodiment also includes the fixing roller 21 (fixing member), the pressing roller 31 (pressing member), and the separating plate 38 (separating member). The positioning members 39 are installed on the separating plate 38 in a detachable manner. The contact portions 39*a* of the positioning members 39 are arranged such that the edges of the contact portions 39*a* on the width-direction center side are positioned inside the paper-passing area L1 and outside the image area L2. The fitting portions 39*b* of the positioning members 39 are arranged outside the paper-passing area L1.

The fitting portion 39*b* is installed onto the separating plate 38 by being fastened with a screw. Specifically, a hole is provided on the fitting portion 39*b*, and a screw 50 is screwed into a female screw in the separating plate 38 via the hole on the fitting portion 39*b*, so that the positioning member 39 is fastened onto the separating plate 38.

Therefore, compared with a case where the fitting portion 39*b* is a snap-fit, the positioning member 39 can be fastened onto the separating plate 38 more firmly, so that the positioning member 39 becomes more resistant to a trouble that the gap G is changed due to a rotation moment around the fitting portion 39*b* applied to the positioning member 39.

As explained above, even in the second embodiment, the edges on the width-direction center side of the contact portions 39*a* of the positioning members 39 are positioned inside the paper-passing area L1 and outside the image area L2. Therefore, a fixing device (or an image forming apparatus) with stable and small gap G between a fixing roller and a separating plate, having relatively shorter fixing roller and separating plate, and having an overall small size can be realized.

Figure 14:
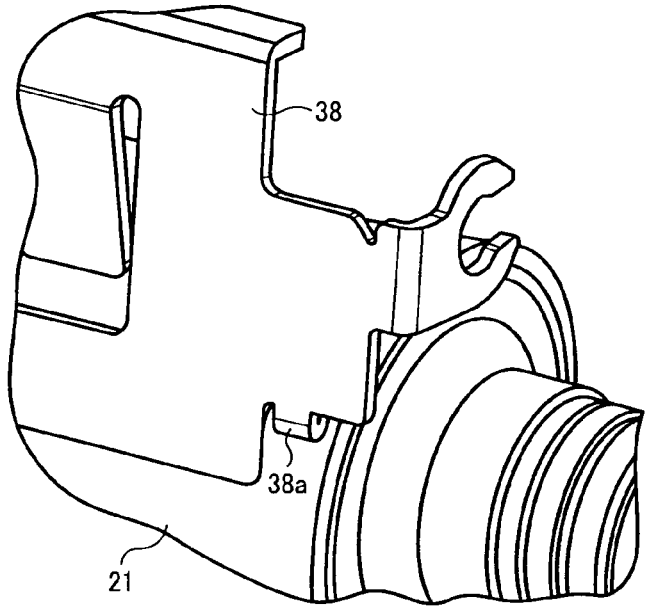
FIG. 14 is an enlarged perspective view that depicts the vicinity of a positioning member of a fixing device according to a third embodiment of the present invention.

A third embodiment according to the present invention is explained below in detail. FIG. 14 is an enlarged perspective view that depicts the vicinity of a positioning member of a fixing device according to the third embodiment, corresponding to FIG. 5 according to the first embodiment. The fixing device according to the third embodiment differs in a point that the positioning members 39 are integrated onto the separating plate 38, from the fixing devices according to the embodiments described above in which the positioning members 39 are provided separately from the separating plate 38.

The fixing device according to the third embodiment includes the fixing roller 21 (fixing member), the pressing roller 31 (pressing member), and the separating plate 38 (separating member).

Positioning portions 38*a* as positioning members are formed on the separating plate 38 in an integrated manner. Specifically, as shown in FIG. 14, each of the positioning portions 38*a* (projected contact portion) is formed by bending on each of the both ends of the separating plate 38 made from a metal. The positioning portions 38*a* are made to come into contact with the fixing roller 21, and the separating plate 38 is pushed toward the fixing roller 21 by a pushing unit, so that the gap G that is desired is formed between the separating plate 38 and the fixing roller 21.

Moreover, the positioning portions 38*a* of the separating plate 38 are arranged such that edges of the positioning portions 38*a* on the width-direction center side are positioned inside the paper-passing area L1 and outside the image area L2.

As explained above, in the third embodiment, the edges on the width-direction center side of the positioning portions 38*a* (the contact portions of the positioning members) are positioned inside the paper-passing area L1 and outside the image area L2. Therefore, a fixing device (or an image forming apparatus) with stable and small gap G between a fixing roller and a separating plate, having relatively shorter fixing roller and separating plate, and having an overall small size can be realized.

Figure 15:
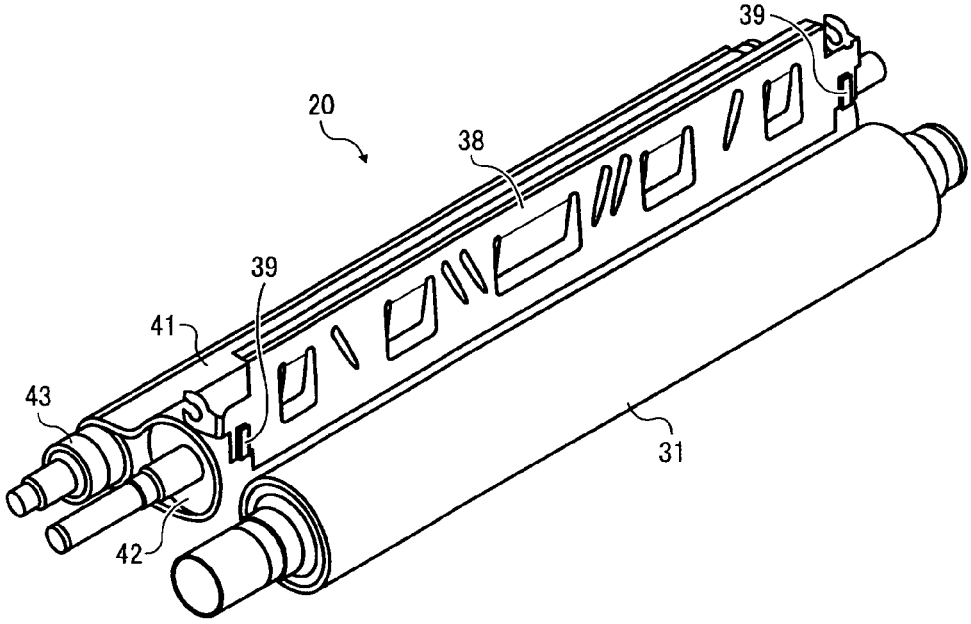
FIG. 15 is a perspective view of a fixing device according to a fourth embodiment of the present invention.

A fourth embodiment according to the present invention is explained below in detail. FIG. 15 is a perspective view of a fixing device according to the fourth embodiment, corresponding to FIG. 3 according to the first embodiment. The fixing device according to the fourth embodiment differs in a point that a fixing belt 41 is used as a fixing member, from the fixing devices according to the embodiments described above that use the fixing roller 21 as a fixing member.

As shown in FIG. 15, the fixing device 20 according to the fourth embodiment includes the fixing belt 41 as a fixing member, a fixing assistant roller 42, and a heating roller 43 as fixing members, the pressing roller 31 and a tension roller (not shown) as pressing members, and the separating plate 38 as a separating member.

The fixing belt 41 is a multilayered endless belt that includes a base layer, an elastic layer, and a release layer, the layers are layered one after another. The base layer is made from a polyimide resin, and is 90 micrometers thick. The elastic layer of the fixing belt 41 is approximately 200 micrometers thick, and made from an elastic material, such as silicone rubber, fluororubber, or expandable silicone rubber. The release layer of the fixing belt 41 is 20 micrometers thick, and made from PFA, polyimide, polyether-imide, PES, or the like. Because of the presence of the release layer on the fixing belt 41, releasability to toner T (a toner image) is ensured. The fixing belt 41 is stretched and supported by a plurality of roller members, namely, the fixing assistant roller 42, the heating roller 43, and the tension roller, and runs in a certain direction.

Alternatively, the base layer can be 70 micrometers thick and the release layer can be 30 micrometers thick.

The fixing assistant roller 42 is a cylindrical member of which outer diameter is 52 millimeters, and includes a central core bar and an elastic layer formed on the core bar. The core bar is made from, for example, SUS304, while the elastic layer is 14 millimeters in layer thickness, and made from a fluororubber, a silicone rubber, an expandable silicone rubber, or the like. The fixing assistant roller 42 is in pressure contact with the pressing roller 31 via the fixing belt 41. Thus, a nip (fixing nip) is present between the fixing assistant roller 42 and the pressing roller 31.

Alternatively, the elastic layer can be 8.5 millimeters thick, and the outer diameter set to 29 millimeters.

The heating roller 43 is a cylinder that is made from a metal, such as aluminum, and has the thickness of 0.6 millimeter and the outer diameter of 35 millimeters, and a heater (heat source) is arranged inside the cylinder. The outer diameter of the heating roller 43 can be 20 millimeters.

The heater is a halogen heater, and both ends of the heater are fastened onto a frame of the fixing device 20. The heating roller 43 is heated with radiation heat from the heater. A power unit (alternating-current power source) (not shown) controls ON/OFF of the heater. When the heater is turned ON, it heats the heating roller 43. The heating roller 43 in turn heats the toner image T on the recording medium P.

A temperature sensor (not shown), or a thermopile, measures the surface temperature of the fixing belt 41. The power unit controls the heater based on the temperature measured by the temperature sensor. Specifically, an alternating-current voltage is applied to the heater for a power distribution time determined based on a detection result obtained by the temperature sensor. As a result, the temperature of the fixing belt 41 (fixing temperature) can be adjusted and controlled to a desired temperature (target control temperature).

The temperature sensor 40 can be a noncontact-type thermopile, a contact-type thermister, or some other temperature sensor.

The pressing roller 31 includes a hollow central core bar having a thickness of 1 millimeter. An elastic layer having a thickness of 1.5 millimeters and made from a silicone rubber, a fluororubber, an expandable silicone rubber, or the like, is formed on the core bar. Alternatively, the hollow core bar can be 4.5 millimeters thick, and the elastic layer can be 3.5 millimeters thick.

The pressing roller 31 is in pressure contact with the fixing assistant roller 42. A pressing unit (not shown) relatively presses the pressing roller 31 and the fixing assistant roller 42 toward each other. The pressing roller 31 and the fixing assistant roller 42 sandwich the fixing belt 41 therebetween. In this way, a desired fixing nip is formed between the pressing roller 31 and the fixing belt 41.

The separating plate 38 is arranged downstream from the nip (near the outlet side of the nip) in a running direction of the fixing belt 41 (fixing member). Specifically, the separating plate 38 is arranged opposite to the fixing belt 41 with a certain gap in between them.

Even in the fourth embodiment, the positioning members 39 are installed on the separating plate 38 in a detachable manner. The contact portions 39*a* of the positioning members 39 are arranged such that the edges of the contact portions 39*a* on the width-direction center side are positioned inside the paper-passing area L1 and outside the image area L2. The fitting portions 39*b* of the positioning members 39 are arranged outside the paper-passing area L1.

The fixing device 20 according to the fourth embodiment operates as described below. When a power switch of the main body of the image forming apparatus 1 is turned on, an alternating-current voltage is applied (supplied) to the heater from an alternating-current power source, and rotational driving of the pressing roller 31 is started by a not-shown driving motor, at the same time, the fixing belt 41 (the fixing assistant roller 42 and the heating roller 43) is driven and rotated.

The recording medium P with an unfixed toner image thereon is fed from the secondary transfer nip to the fixing device 20. Specifically, the recording medium P with the unfixed image T is inserted into the fixing nip between the fixing belt 41 and the pressing roller 31. The toner image T is then fixed onto the surface of the recording medium P by virtue of heat from the fixing belt 41 and a pressing force of the fixing belt 41 (the fixing assistant roller 42) and the pressing roller 31. The recording medium P is then sent out from the fixing nip by the fixing belt 41 and the pressing roller 31 both of which are rotating.

As explained above, even in the fourth embodiment, similarly to the embodiments described above, the edges on the width-direction center side of the contact portions 39*a* of the positioning members 39 are positioned inside the paper-passing area L1 and outside the image area L2. As a result, a fixing device (or an image forming apparatus) with stable and small gap G between a fixing belt and a separating plate, having relatively shorter fixing belt and separating plate, and having an overall small size can be realized.

According to each of the embodiments, the present invention is applied to the fixing device 20 that uses the heater 25 as a heating unlit. However, the present invention can be applied to a fixing device of an electromagnetic induction heating type that uses an excitation coil as a heating unit.

According to each of the embodiments, the present invention is applied to the fixing device that uses the pressing roller 31 as a pressing member. However, the present invention can be applied to a fixing device that uses a pressing belt or a pressing pad as a pressing member.

The present invention is not limited to the embodiments. In other words, each of the embodiments can be modified as required within a scope of a technical idea of the present invention in addition to modifications suggested in the embodiments. The number of pieces, positions, shapes, and the like of components and members, are not limited to the embodiments, and can be preferably determined when implementing the present invention.

According to one aspect of the present invention, it is possible to provide a fixing device (or an image forming apparatus) with stable and small gap G between a fixing member and a separating member, having relatively shorter fixing member and separating member, and having an overall small size can be realized.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing device comprising:

a fixing unit that fixes a toner image onto a recording medium by heating and fusing the toner image;

a pressing unit that is in pressure contact with the fixing unit thereby forming a nip with the fixing unit through which a recording medium is carried;

a separating unit that is arranged downstream from the nip in a running direction of the fixing unit, and placed opposite to the fixing unit with a certain gap in between; and positioning units that are installed on the separating unit to be in contact with width-direction ends of the fixing unit by being pushed directly or indirectly by a pushing unit for determining the gap, wherein the positioning units are arranged such that edges on a width-direction center side of contact portions in contact with the fixing unit are positioned outside an image area and inside a paper-passing area for a recording medium of a maximum passing-capable size.

2. The fixing device according to claim 1, wherein the separating unit is formed such that width-direction ends of tips of the separating unit on which the gap is formed are positioned outside the paper-passing area.

3. The fixing device according to claim 1, wherein each of the positioning units includes a fitting portion with which the positioning unit is to be installed on the separating unit in a detachable manner, and the fitting portion is arranged outside the paper-passing area.

4. The fixing device according to claim 3, wherein the fitting portion is a snap-fit.

5. The fixing device according to claim 3, wherein the fitting portion is fit to the separating unit with a screw.

6. The fixing device according to claim 3, wherein each of the positioning units includes a stopper that restricts rotation of the contact portion around the fitting portion.

7. The fixing device according to claim 1, wherein the positioning units are formed on the separating unit in an integrated manner.

8. The fixing device according to claim 1, wherein the contact portions of the positioning units are arranged such that edges of the contact portions on width-direction edge sides are positioned inside positions of width-direction ends of the fixing unit.

9. The fixing device according to claim 1, wherein the gap is set to be from 0.1 millimeter to 0.8 millimeter under a state where the fixing unit is heated.

10. The fixing device according to claim 1, wherein the positioning units are made from one of a resin and a metal.

11. An image forming apparatus comprising a fixing device, the fixing device including a fixing unit that fixes a toner image onto a recording medium by heating and fusing the toner image;

a pressing unit that is in pressure contact with the fixing unit thereby forming a nip with the fixing unit through which a recording medium is carried;

a separating unit that is arranged downstream from the nip in a running direction of the fixing unit, and placed opposite to the fixing unit with a certain gap in between; and positioning units that are installed on the separating unit to be in contact with width-direction ends of the fixing unit by being pushed directly or indirectly by a pushing unit for determining the gap, wherein the positioning units are arranged such that edges on a width-direction center side of contact portions in contact with the fixing unit are positioned outside an image area and inside a paper-passing area for a recording medium of a maximum passing-capable size.

12. A separating unit configured to be placed opposite to a fixing unit with a certain gap in between, the fixing unit fixing a toner image onto a recording medium by heating and fusing the toner image, wherein the separating unit is configured to be arranged downstream from a nip in a running direction of the fixing unit, the nip being formed between the fixing unit and a pressing unit, positioning units that are pushed by a pushing unit directly or indirectly for determining the gap, and in contact with width-direction ends of the fixing unit are installed on the separating unit, and the positioning units are arranged such that edges on a width-direction center side of contact portions of the positioning units in contact with the fixing unit are positioned outside an image area and inside a paper-passing area for a recording medium of a maximum passing-capable size.

13. The separating unit according to claim 12, wherein each of the positioning units includes a fitting portion with which the positioning unit is to be installed on the separating unit in a detachable manner, and the fitting portion is arranged outside the paper-passing area.

* * * * *